US005366045A

United States Patent [19]

Liston

[11] Patent Number: 5,366,045

[45] Date of Patent: Nov. 22, 1994

[54] BRAKE MECHANISM FOR A STORAGE AND RETRIEVAL VEHICLE

[75] Inventor: Sergay Liston, Centerville, Utah

[73] Assignee: Eaton Corporation, Cleveland, Ohio

[21] Appl. No.: 115,617

[22] Filed: Sep. 3, 1993

[51] Int. Cl.[5] ..... B66B 5/16

[52] U.S. Cl. ..... 187/376; 188/67

[58] Field of Search ..... 187/89, 90, 88, 80; 188/189, 188, 180, 182, 67

[56] References Cited

U.S. PATENT DOCUMENTS

| | | | |
|---|---|---|---|
| 2,150,373 | 3/1939 | Hymans | 187/90 |
| 3,119,464 | 1/1964 | Rountree | 187/89 |
| 3,232,382 | 2/1966 | Buck | 187/89 |
| 3,249,179 | 5/1966 | Borgman | 187/88 |
| 3,601,227 | 8/1971 | Burch | 187/89 |
| 4,240,529 | 12/1980 | Hagmann et al. | 187/90 |
| 5,141,081 | 8/1992 | Kregel et al. | 187/87 |
| 5,159,995 | 11/1992 | Sissala et al. | 187/88 |
| 5,209,325 | 5/1993 | Gines et al. | 188/67 |
| 5,228,540 | 7/1993 | Glaser | 187/89 |

FOREIGN PATENT DOCUMENTS

| | | | |
|---|---|---|---|
| 3706802 | 9/1988 | Germany | 187/88 |

*Primary Examiner*—Kenneth W. Noland

*Attorney, Agent, or Firm*—Frank M. Sajovec

[57] ABSTRACT

An overspeed brake mechanism for a storage and retrieval vehicle (SRV). The brake mechanism includes wedges acting between a brake block attached to the load carriage of the SRV and a rail fixed to the mast of the SRV. The wedges are biased into braking engagement with the mast and are held out of braking engagement under normal operating conditions by a solenoid acting through a linkage system, the solenoid being de-energized by a control system responsive to an overspeed signal from a tachometer generator on the load carriage and having its input member in engagement with the mast. In accordance with one aspect of the invention, permanent magnets embedded in the wedges bias the wedges away from contact with the rail to prevent inadvertent engagement of the brake system while maintaining the wedges in position for rapid engagement.

5 Claims, 5 Drawing Sheets

BRAKE MECHANISM FOR A STORAGE AND RETRIEVAL VEHICLE

The present invention relates to storage and retrieval vehicles (SRV), and more particularly to an overspeed brake mechanism for such vehicles.

Storage and retrieval vehicles typically include an overspeed brake device which is operable to stop the descent of the load carriage of the vehicle in the event of failure of the carriage lift mechanism, such as the severing of the carriage lift cable. In the SRV system to which the present invention is applied, the prior art overspeed brake consists of a toothed cam pivotally mounted on a brake block fixed to the load carriage and engageable with a surface formed on the mast. Actuation of the cam is accomplished by a linkage connected to a centrifugal speed sensing device.

While the prior art system has proved to be an effective safety device, the engagement of the cam teeth with the mast causes damage to the mast and can be difficult to disengage, Also, the centrifugal actuator requires a rack or other positive engagement device running essentially the full vertical length of the SRV mast for actuation.

In an SRV which employs a double mast, an overspeed brake is required on both masts in order to keep the load carriage level. In such application, it is difficult to mechanically link two brake assemblies to a single centrifugal sensing mechanism, and multiple centrifugal sensors are difficult to synchronize. U.S. Pat. No. 5,209,325 assigned to the assignee of this application and which is incorporated herein by reference, discloses a brake system for a double-masted SRV wherein a single, roller-driven generator energizes series-connected solenoids which actuate each of the brake mechanisms when the generated voltage reaches a value corresponding to an overspeed condition; however, that system still employs a toothed cam brake mechanism.

Accordingly, it is an object of the present invention to provide an overspeed brake system for a storage and retrieval vehicle which does not cause damage to the mast structure and which does not require an elongated rack or the like for actuation.

A further object of the invention is to provide an overspeed brake system as in the above object which can be easily synchronized when applied to a double-masted SRV.

To meet the above objectives, the present invention provides an overspeed brake which is in the form of a pair of opposed wedges acting on a guide rail fixed to the mast. The wedges are normally biased into engagement with the guide rail and during normal operation are held in a disengaged position. A tachometer generator senses the speed of the carriage relative to the mast and when an overspeed condition occurs energizes a circuit which is effective to remove the disengaging force, thus permitting the wedges to actively engage the guide rail and stop the movement of the load carriage relative to the mast. In accordance with a preferred embodiment of the invention, the wedges are held in a disengaged position by a linkage system connected to the output of a linear actuator such as a solenoid.

In accordance with another aspect of the invention, the wedges are maintained out of engagement with the guide rail by means of permanent magnets when the wedges are in a disengaged condition to avoid premature actuation of the brake due to friction between the wedges and the guide rail.

Other objects and advantages of the invention will be apparent from the following description, when taken in connection with the accompanying drawings, wherein.

Figure 1:
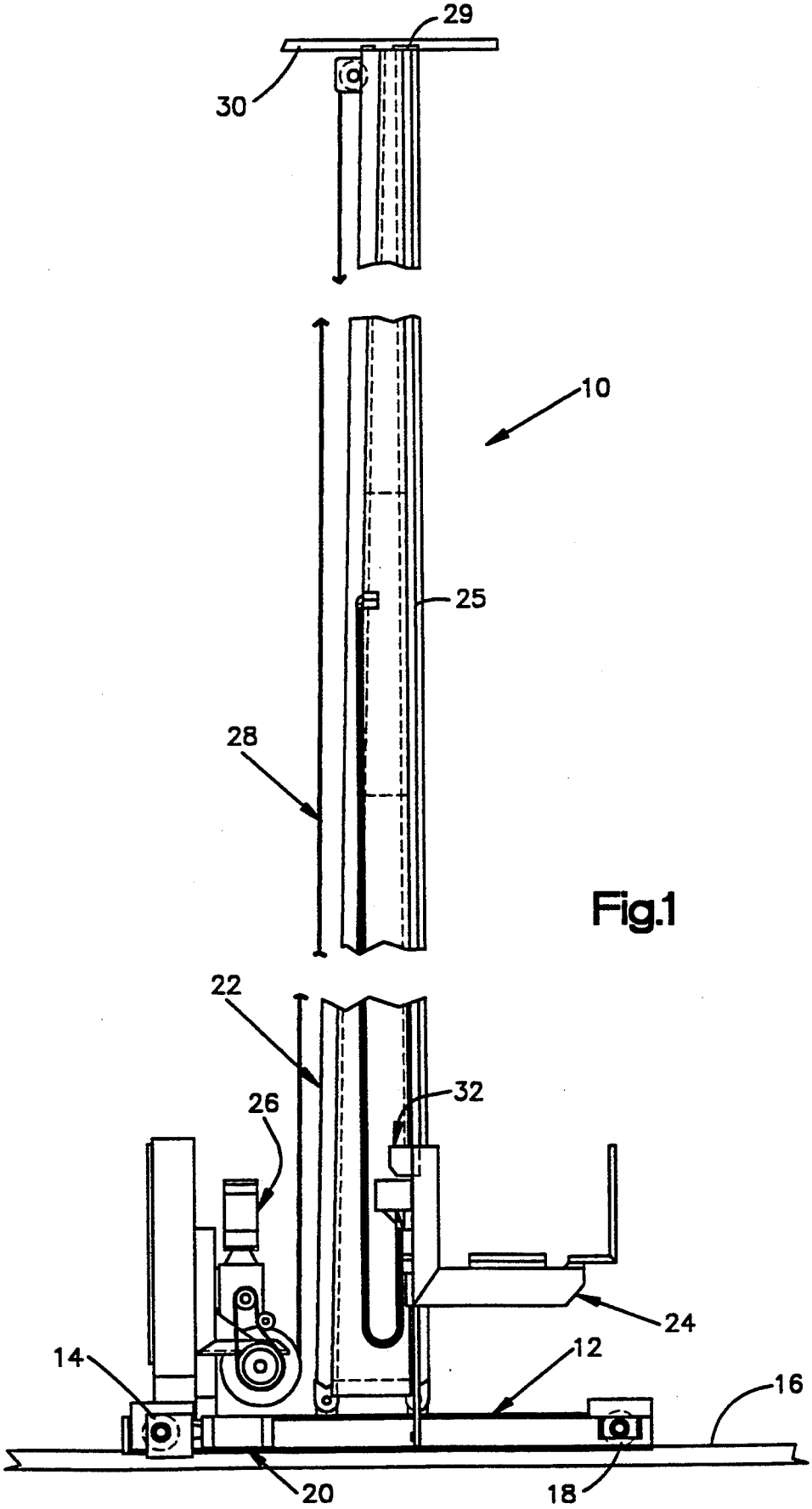
FIG. 1 is an elevation view of a storage and retrieval vehicle incorporating the invention.
Figure 2:
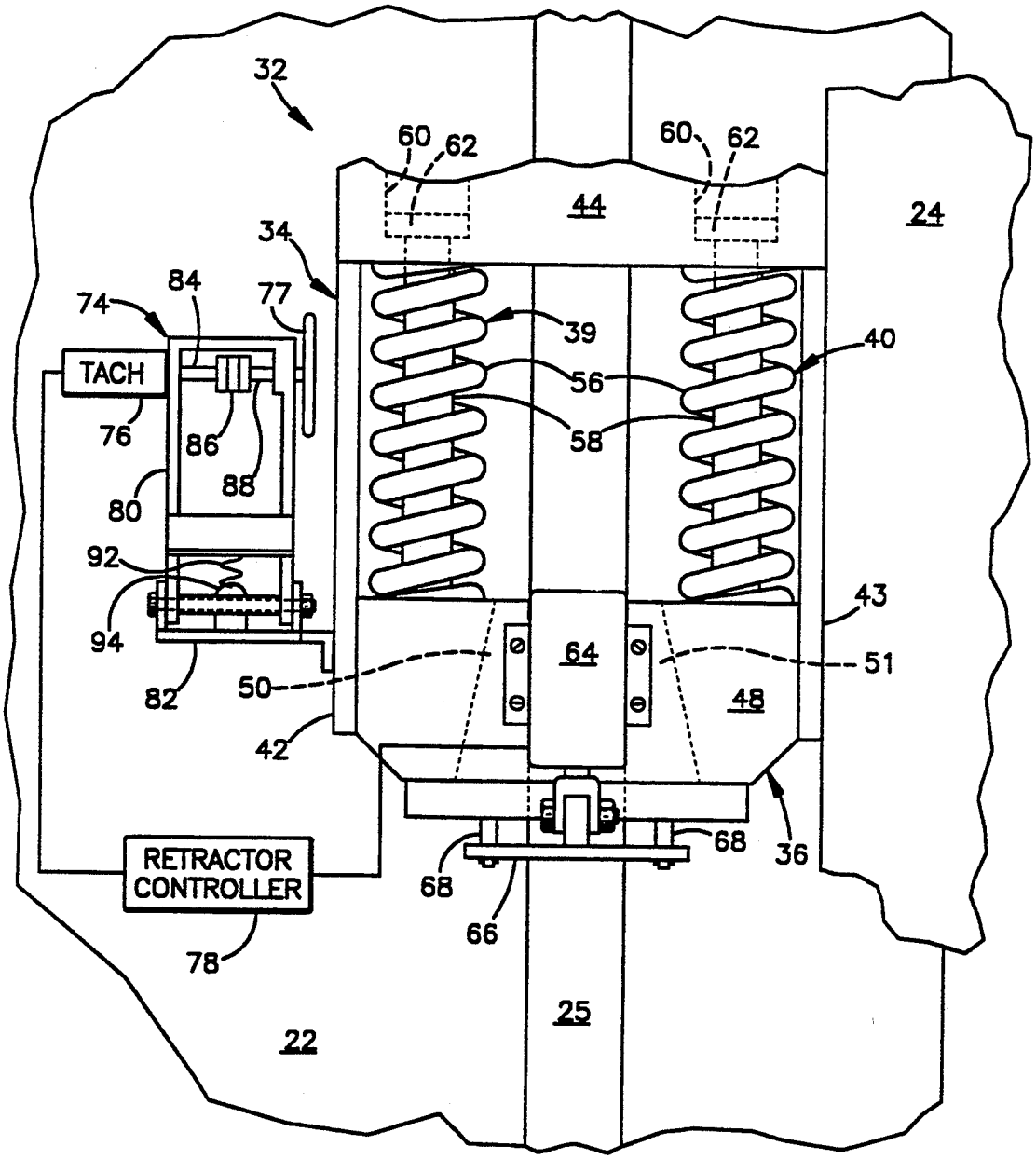
FIG. 2 is a schematic, front elevation view of a preferred embodiment of the invention.

Referring to FIG. 1, there is illustrated an SR vehicle 10 comprising a base assembly 12, a drive wheel 14 mounted for rotation on the frame 12 and engageable with a floor supported rail 16, an idler wheel 18 mounted for rotation on the frame and engageable with the rail 16, a drive motor assembly 20 mounted on the frame and operatively connected to the drive wheel to drive the SR vehicle along the rail, a mast assembly 22 mounted to the frame, a load carriage assembly 24 mounted to the mast assembly for vertical movement along a guide rail 25 attached to the mast, and a vertical drive assembly 26 mounted on the frame and operable to drive the load carriage up and down the mast by means of a cable system 28. The vehicle is stabilized by means of horizontal guide wheels 29 which engage an overhead rail 30.

The SR vehicle 10 includes an overspeed brake assembly 32 which is mounted on the load carriage 24 and which engages the guide rail 25 to stop downward travel of the load carriage in the event of a failure of the vertical drive system, such as breakage of the cable 28.

Referring to FIGS. 2–5, the brake assembly comprises a frame assembly 34 fixed to the load carriage 24, a brake block assembly 36 engageable with the guide rail 25, and energy absorber units 39 and 40 operable to cushion the shock loads which can occur upon actuation of the brake.

The frame assembly 34 comprises a pair of spaced apart side plates 42 and 43, one of which is fixed to the load carriage 24; an upper block 44 connecting the side plates; and retaining plates 46, 47 fixed to the brake block assembly in position to retain the wedges as will be described below.

Figure 4:
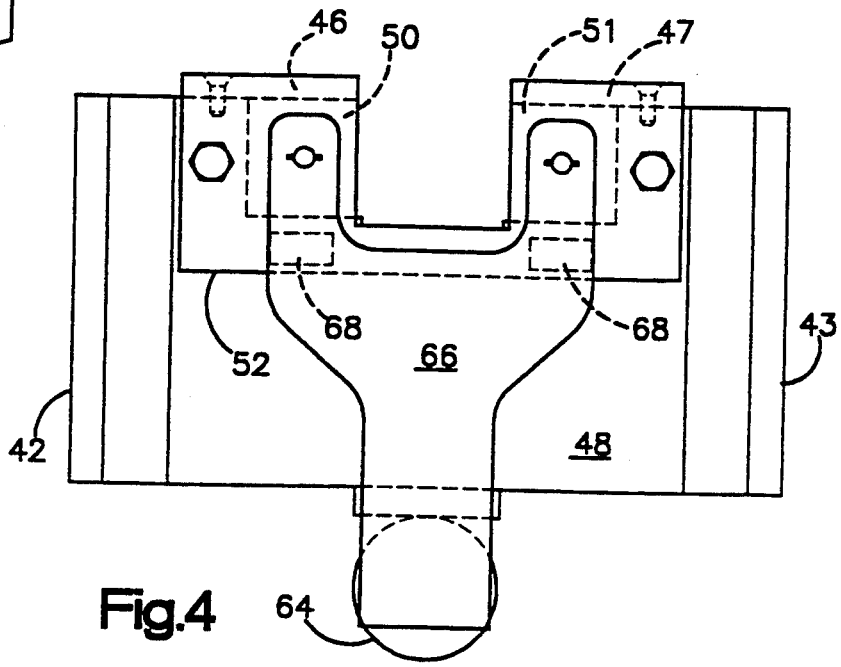
FIG. 4 is a bottom plan view of the embodiment of FIG. 2.
Figure 5:
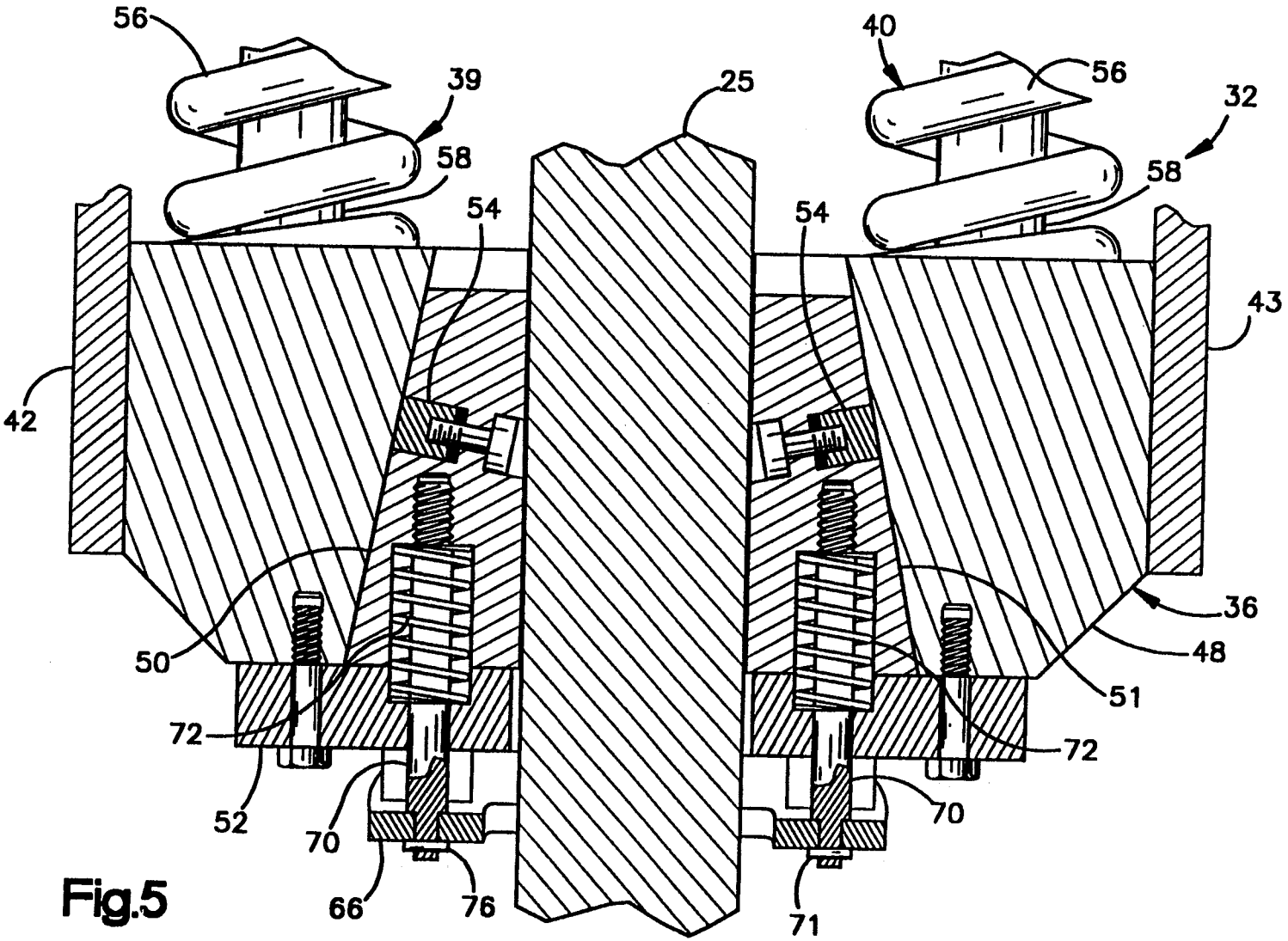
FIG. 5 is a partial section view taken at line 5—5 of FIG. 3.

Referring particularly to FIGS. 4 and 5, the brake block assembly 36 comprises a relatively massive U-shaped block 48 slidingly received between the side plates 42, 43; first and second wedge members 50, 51 received within the legs of the "U" in position to engage the guide rail 25; a bottom wedge retaining plate 52 bolted or otherwise fastened to the brake block, and permanent magnets 54 received in recesses formed in each of the wedges and operable to maintain the wedges in contact with the brake block 48.

The shock absorbers 39 and 40 comprise pairs (only one of each shown in FIG. 2) of die springs 56 received between the brake block and the upper block 44 and stabilizer bars 58 received within the springs and threaded into the brake block. Each of the bars is received in a stepped bore 60 formed in the block 44 and has a head 62 formed on it which engages the block to support the brake block assembly during normal operation of the SR vehicle. Hydraulic shock absorbing units (not shown) can also be added to add damping to the shock absorbing system.

In the illustrative embodiment, the brake assembly 32 is normally held in a disengaged condition by retracting means comprising a solenoid 64 bolted or otherwise fastened to the brake block, a forked lever 66 connected at one end to the output member of the solenoid and in contact with fulcrums 68 attached to the retainer 52, and connected at the opposite end to retractor links 70 threaded into each of the wedges 50 and 51 and attached to the lever 66 by pin connections 71.

Figure 3:
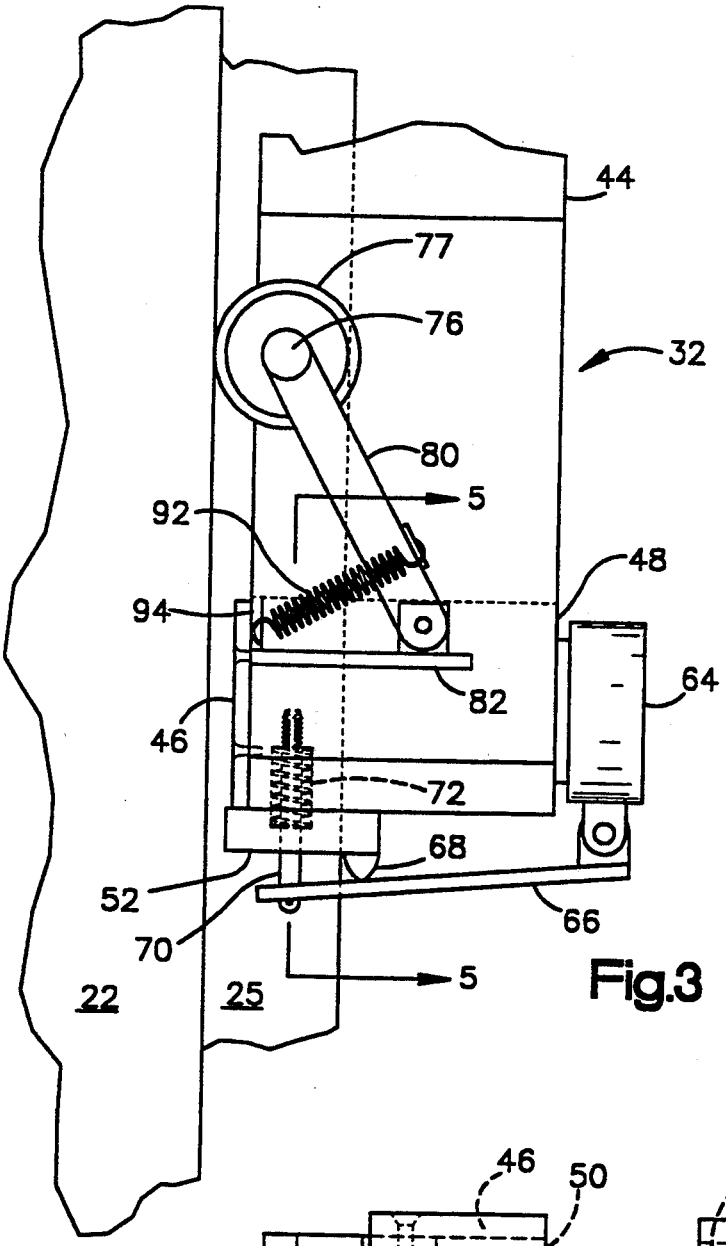
FIG. 3 is a side elevation view of the embodiment of FIG. 2.

The wedges are normally held in braking engagement with the rail 25 by springs 72 received in aligned bores formed in the wedges and in the retainer 52. The solenoid 64 is maintained in a "normally on" or retracted condition as shown in FIG. 3 which causes the lever to pivot counterclockwise about the fulcrums 68 to cause the links 70 to exert a downward force on the wedges to overcome the force of the springs 72 and hold the wedges out of braking engagement with the rail. It can be appreciated that the wedges go through very limited movement between the engaged and disengaged conditions. While the retracting means is illustrated herein as being a solenoid, it can be appreciated that another type of actuator, such as an air cylinder or a hydraulic cylinder, can also be used. The permanent magnets 54 are fixed to the wedges by screws 55 received in recesses formed in the wedge and apply an attractive force to the block 48 to bias the wedges away from friction engagement with the rail 25. This insures that when the wedges are in a retracted condition in normal operation, there will not be sufficient friction force between the wedges and the rail to cause the wedges to tend to self engage.

Overspeed sensing is provided by a sensor system 74 which comprises a tachometer generator 76 driven by a wheel 77 engaged with the mast 22, and a controller 78 connected to the electromagnets 64. The controller is operative to energize the solenoid and includes circuitry which converts the tach generator output into a signal which is effective to de-energize the solenoid or other actuator and thus remove the wedge retracting force against the springs 72 to permit the springs to move the wedges into friction engagement with the rail 25. The tach generator is mounted on a frame 80 which is pivotally mounted on a platform 82 attached to side plate 42. The input shaft 84 of the tach generator is connected, through a coupling 86, to an axle 88 which is mounted for rotation in the frame 80 and which receives the wheel 77. Referring to FIG. 3, the wheel is held in engagement with the mast 22 by means of an extension spring 92 connected between the frame and a tab 94 formed on the platform 82. The controller 78 is set to open the electrical circuit to the solenoid 64 at a predetermined output signal provided by the tach generator. Such circuits are well known in the art and will not be described in detail herein. Since the output of the tach generator is proportional to the input speed as determined by the wheel 77, the predetermined signal is set at a level which is realized only when an overspeed condition occurs.

It can be appreciated that a loss of electrical power to the SR vehicle will also cause the wedges to move into braking engagement with the rail.

Figure 6:
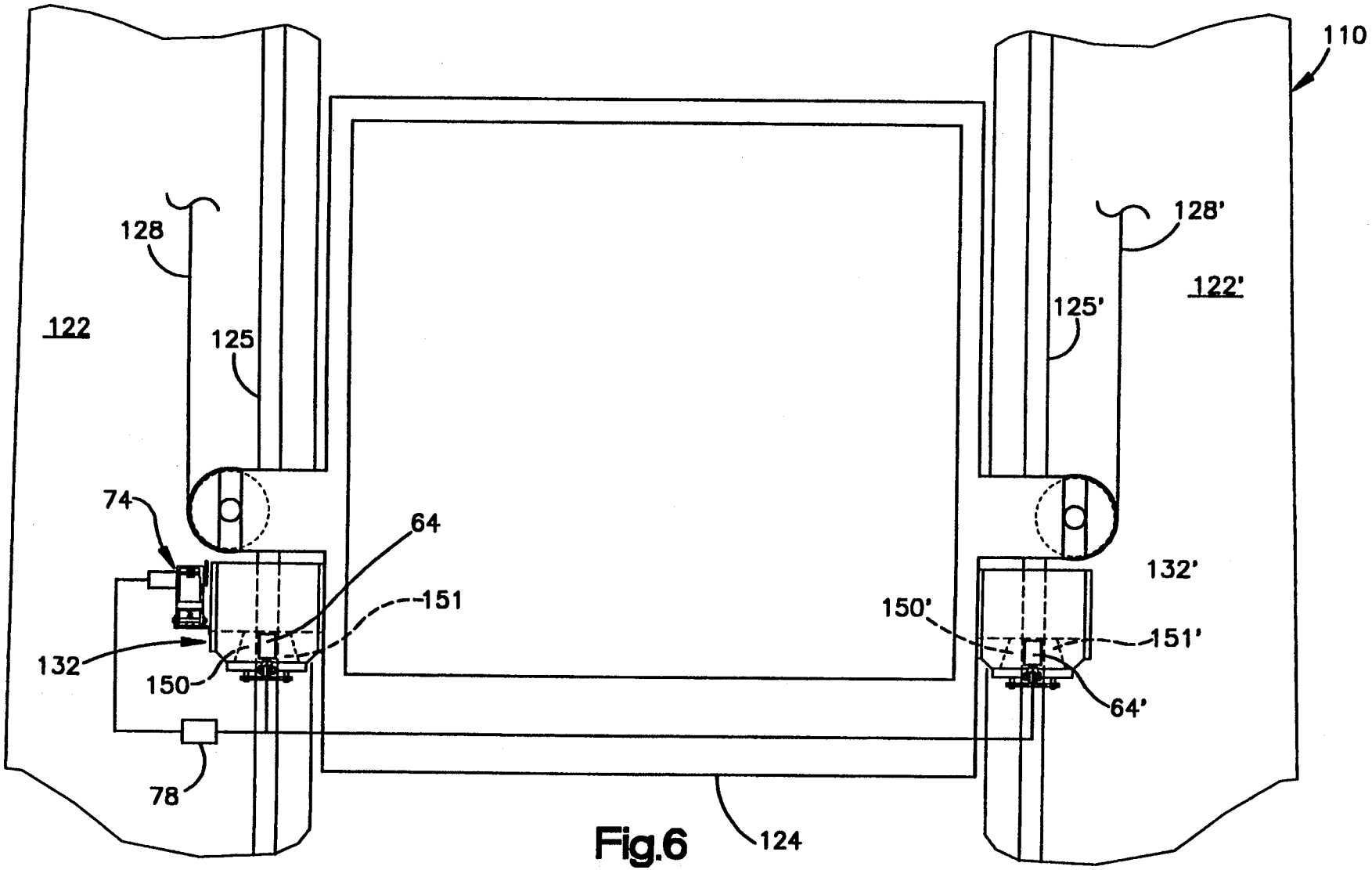
FIG. 6 is a schematic representation of the application of the invention to a double-masted SRV.

FIG. 6 illustrates the application of the FIG. 5 embodiment to a double-masted SRV 110 including masts 122 and 122', and a single load carriage 124. Each mast includes a guide rail 125 and 125', and the load carriage is driven up and down the masts by cable systems 128 and 128'. In this system, overspeed brake assemblies 132 and 132' are mounted on either side of the load carriage 124 and operate on the guide rails 125 and 125' respectively; however, a single sensor system 74 is mounted on one of the brake assemblies with the controller 78 connected in parallel to the brake assemblies. It should be noted that the permanent magnets 54 are particularly important in a double mast application since they insure that there will be no inadvertent engagement of the brakes, while still maintaining the wedges 150, 151 and 150', 151' in position to engage synchronously with minimal motion of the load carriage after an overspeed or loss-of-power signal is received.

I claim:

1. A brake apparatus for a load carriage mounted for vertical movement along an elongated mast, comprising a brake block attached to said load carriage, one or more wedge members acting between said brake block and said mast and movable between a first position permitting relative movement between said load carriage and said mast and a second position preventing movement between said load carriage and said mast, means biasing said wedge members into said second position, retracting means operable to apply a force to said wedge members opposing said biasing means to hold said wedge members in said first position, a tachometer generator having its input member in engagement with said mast to generate an electrical signal proportional to the relative speed between said load carriage and said mast, control means connected to said retracting means and responsive to said signal to deactuate said retracting means when said relative speed reaches a predetermined value, and permanent magnet means attached to said one or more wedge members in position to apply a magnetic attractive force to said brake block.

2. Apparatus as claimed in claim 1 in which said means biasing said one or more wedge members comprises spring means acting between said one or more wedge members and said brake block.

3. Apparatus as claimed in claim 1 in which said retracting means comprises a solenoid mounted on said brake block and having an output member operatively connected to said one or more wedge members.

4. Apparatus as claimed in claim 1 in combination with a storage and retrieval machine comprising a first elongated mast mounted on said machine; a second elongated mast mounted on said machine in spaced parallel relation to the first mast; said load carriage being mounted for vertical movement between said first and second masts; said combination including a first brake apparatus comprising one or more wedge members operatively acting between said load carriage and said first mast and a second brake apparatus comprising one or more wedge members operatively acting between said load carriage and said second mast.

5. Apparatus as claimed in claim 1, in which each of said one or more wedge members comprises an angled surface engageable with said brake block, an opening formed in said angled surface, a permanent magnet received in said opening, and means for retaining said magnet in said opening.

* * * * *